US007980286B2

(12) United States Patent
Bartusiak et al.

(10) Patent No.: US 7,980,286 B2
(45) Date of Patent: Jul. 19, 2011

(54) DEVICE FOR APPLYING A PROTRUDING TAB TO DOUBLE-SIDED ADHESIVE TAPE, AND METHOD OF USING

(75) Inventors: Joseph T. Bartusiak, Osseo, MN (US); James F. Pitzen, Stillwater, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 670 days.

(21) Appl. No.: 11/958,564

(22) Filed: Dec. 18, 2007

(65) Prior Publication Data

US 2010/0147455 A1 Jun. 17, 2010

(51) Int. Cl.
*B29C 65/00* (2006.01)

(52) U.S. Cl. ..... 156/522; 156/564; 156/573; 225/29; 225/39; 225/56; 225/77; 206/411; 242/364.1; 242/588.3

(58) Field of Classification Search ..... 156/289, 156/302, 522, 530, 538, 552, 564, 573, 577, 156/269, 378; 225/27, 39, 56, 77; 206/411; 242/364.1, 588.3

See application file for complete search history.

(56) References Cited

U.S. PATENT DOCUMENTS

| | | | | |
|---|---|---|---|---|
| 2,754,023 | A * | 7/1956 | Sheridan | 156/522 |
| 4,024,312 | A | 5/1977 | Korpman | |
| 4,231,837 | A * | 11/1980 | Ramey et al. | 156/522 |
| 5,045,139 | A * | 9/1991 | Vonk | 156/152 |
| 5,118,381 | A | 6/1992 | Ryder et al. | |
| 5,491,012 | A | 2/1996 | Lühmann et al. | |
| 5,516,581 | A | 5/1996 | Kreckel et al. | |
| 5,662,578 | A | 9/1997 | Phelps | |
| 5,980,676 | A * | 11/1999 | Meetze | 156/216 |
| 6,065,520 | A * | 5/2000 | Lee et al. | 156/530 |
| 6,641,910 | B1 | 11/2003 | Bries et al. | |
| 6,732,777 | B2 * | 5/2004 | Ertel et al. | 156/353 |
| 2008/0083487 | A1 * | 4/2008 | Moss et al. | 156/250 |

FOREIGN PATENT DOCUMENTS

| | | |
|---|---|---|
| KR | 10-2000-0048898 A | 7/2000 |
| KR | 10-2001-0080439 | 8/2001 |

* cited by examiner

*Primary Examiner* — Linda L Gray
(74) *Attorney, Agent, or Firm* — Kenneth B. Wood

(57) ABSTRACT

Herein is disclosed a device and method for attaching a tab to an elongate length of double-sided adhesive tape, the tab protruding beyond a terminal end of the elongate length of tape and being attached to both surfaces of the adhesive tape.

17 Claims, 7 Drawing Sheets

DEVICE FOR APPLYING A PROTRUDING TAB TO DOUBLE-SIDED ADHESIVE TAPE, AND METHOD OF USING

BACKGROUND

Adhesive tapes have been in use for many years. Devices and methods are known whereby a portion of an adhesive tape may be detackified or otherwise rendered non-adhesive. For example, U.S. Pat. No. 5,118,381 to Ryder and Ranalletta discloses a tape dispenser apparatus for tape having an adhesive surface, that includes a compartment for holding a plurality of individual tabs which can be successively removed from the compartment and applied to portions of the adhesive tape surface to provide multiple, covered adhesive surface portions of the tape. PCT International Publication No. WO 98/06652 discloses a length cutting fixture which can be used to form a pull tab or "gripper" at the end of a long length of a conventional single-sided adhesive tape. The length cutting fixture also serves to cut the long length of tape, now including the gripper, to any desired length. The gripper is formed by folding the end of the tape back onto itself So called double-sided adhesive tapes (i.e., tapes bearing adhesive on both major opposing surfaces) are also widely known. For example, so-called stretch releasing adhesive tapes are useful in a wide variety of assembling, joining, attaching, and mounting applications. Devices and methods are known whereby the adhesive surface of a particular portion of a stretch releasing adhesive tape can be rendered non-adhesive so that this portion of the adhesive tape can serve as a nonadhesive pull tab (such that the user can grasp and pull the tab to activate the stretch releasing properties of the tape). For example, U.S. Pat. No. 5,491,012 to Luhmann et al. discloses a strip of an adhesive film for a re-releasable adhesive bond, one end of the strip being provided on both sides with a UV-opaque covering which at the same time serves as a tab for pulling. U.S. Pat. No. 6,641,910 to Bries and Johansson discloses a stretch releasing tape that includes a segmented liner that can be used to form a manually engagable pull tab.

SUMMARY

Herein is disclosed a device and method for providing an elongate length of double-sided adhesive tape with a protruding tab at a terminal end of the length of tape. In particular, herein is disclosed a device and method for providing an elongate length of stretch releasing adhesive tape with a protruding tab at a terminal end of the length of tape. Such a protruding tab (often called a pull tab) can be grasped and pulled by a user to activate the stretch release properties of the tape.

Applicant discloses a device comprising a stack of individual tab pieces from which individual tab pieces may be removed and attached to a terminal end of an elongate length of double-sided adhesive tape. The tabs are provided in a tab piece storage and attachment unit. In one embodiment the tab piece storage and attachment unit is elongated with first and second ends, and comprises at least first and second major walls. (The tabs may be held within the unit by additional optional side walls and end walls, or may be held by the pressure imparted by a biasing element, as described in detail later herein). The first major wall of the unit comprises a window proximate the first end of the unit, which serves to expose a portion of one major surface of the uppermost tab piece in the stack of individual tab pieces, such that a terminal end of a length of double-sided adhesive tape can be placed in overlapping relation with the window and deformed into the window such that the first major adhesive surface of the adhesive tape contacts the exposed major surface of the uppermost tab piece and adheres the tab piece to the adhesive surface. The double-sided adhesive tape can then be withdrawn from proximity to the window, thereby removing the adhered tab piece from the tab piece stack while leaving the remaining tab pieces in the tab piece storage and attachment unit.

This device and procedure thus provides a length of double-sided adhesive tape with a tab piece attached to a terminal end. In one embodiment, the window in the first major wall of the unit is sized and positioned such that the distal end of the attached tab piece protrudes past the terminal edge of the terminal end of the length of adhesive tape. Thus, the distal end of the protruding portion of the tab piece can then be wrapped over the terminal end and adhered to the second major side of the adhesive tape (release liner, if present, having been removed). Specifically, the tab pieces are sized, and the window is sized and positioned, such that the distal end of the attached tab piece protrudes sufficiently past the terminal edge of the terminal end of the tape that, upon wrapping the tab piece over the terminal end and attaching the distal end of the tab piece to the second major surface of the tape, a portion of the thus-formed protruding tab extends sufficiently beyond the terminal edge of the terminal end of the adhesive tape to be easily graspable by a user. Thus is provided an elongate length of double-sided adhesive tape with a pull tab attached to a terminal end thereof and protruding beyond the terminal end.

The tab piece storage and attachment unit may be provided alone, or may be provided along with (e.g. attached to, or as an integrally formed portion of) a dispenser for dispensing double-sided adhesive tape. When provided along with a tape dispenser, the tab piece storage and attachment unit, and the roll of adhesive tape, are arranged so that when the terminal end of the tape is positioned in overlapping relation with the window proximate the first end of the tab piece storage and attachment unit, the tape is not in overlapping relation with the second end of the unit. That is, the elongate length of the tape extends from the window in the direction away from the second end of the unit, rather than extending in the direction of the second end of the unit (i.e., rather than extending over the non-window portion of the unit). This configuration ensures that the portion of the uppermost tab that is not exposed through the window, protrudes beyond the terminal edge of the terminal end of the double-sided tape. Thus, when a tab is attached to a length of tape and removed from the window, a portion of the tab protrudes beyond the terminal end of the tape.

Applicant thus discloses in one aspect: a dispenser comprising a frame; a roll of double-sided adhesive tape positioned on the frame, the roll of tape having a terminal end; a tab piece storage and attachment unit arranged on the frame, the unit having an elongated shape with first and second ends and comprising at least first and second major opposing walls extending at least partially between the first and second ends, the unit further comprising a plurality of individual tab pieces in a stack comprising first and second opposed major surfaces, wherein the tab piece stack is arranged between the first and second major opposing walls, wherein the first major opposing wall contains a window that is proximate the first end of the tab piece storage and attachment unit and that exposes at least a portion of the first major surface of the tab piece stack, wherein the first major opposing wall further comprises anon-window portion located between the window and the second end of the elongated tab piece storage and attachment unit; and wherein the tab piece storage and attachment unit and the roll of tape are arranged such that when the terminal end of the tape is positioned in overlapping relation with the window, the tape is not in overlapping relation with the non-window portion of the first major opposing wall of the tab piece storage and attachment unit.

Applicant thus discloses in another aspect: a method of dispensing a length of double-sided adhesive tape with a tab attached to a terminal end of the adhesive tape, comprising: providing a tab piece storage and attachment unit comprising a plurality of individual tab pieces arranged in a stack with first and second major surfaces, the tab piece storage and attachment unit having an elongated shape with first and second ends and comprising at least first and second major opposing walls extending at least partially between the first and second ends, the first major opposing wall comprising a window that is proximate the first end of the tab piece storage and attachment unit and that exposes a portion of the first major surface of the tab piece stack; providing a length of double-sided adhesive tape comprising first and second major adhesive surfaces, and comprising a terminal end that comprises a terminal edge; positioning the first major adhesive surface of the terminal end of the adhesive tape in overlapping relation with the window; pressing on at least a portion of the second major surface of the terminal end of the adhesive tape that is in overlapping relation with the window, such that the first major adhesive surface of the tape comes in contact with the first major surface of the tab stack causing an uppermost individual tab piece of the tab piece stack to be attached to the first major adhesive surface of the adhesive tape; withdrawing the terminal end of the tape from the window, causing the uppermost individual tab piece of the tab piece stack to be removed from the tab piece storage and attachment unit, and thus providing a length of double-sided adhesive tape with a tab attached to the first major adhesive surface of the terminal end of the tape and protruding past the terminal end of the tape; wrapping the protruding portion of the tab over the terminal end of the tape, and attaching the first major surface of the tab to the second major surface of the adhesive tape, such that a portion of the tab protrudes past the terminal end of the tape; thus providing a length of double-sided adhesive tape with a tab attached to both major surfaces of the adhesive tape and protruding past the terminal end of the length of adhesive tape.

Applicant thus discloses in still another aspect: a device for attaching a protruding tab to a terminal end of an elongate length of double-sided adhesive tape, the device comprising: a tab piece storage and attachment unit containing a plurality of individual tab pieces arranged in a stack with first and second major surfaces, the tab piece storage and attachment unit having an elongated shape with first and second ends and comprising at least first and second major opposing walls extending at least partially between the first and second ends, wherein the first major opposing wall comprises a window that exposes at least a portion of the first major surface of the tab piece stack, the window defined on all sides by edges, wherein the edges comprise leading and trailing edges that are oriented substantially transversely to the longitudinal axis of the elongated unit, and first and second side edges that are oriented substantially parallel to the longitudinal axis of the elongated unit; and wherein the tab piece storage and attachment unit comprises a flange positioned at the leading edge of the window, wherein the flange is in overlapping relation with a portion of the first major surface of the tab piece stack.

These and other aspects of the invention will be apparent from the detailed description below. In no event, however, should the above summaries be construed as limitations on the claimed subject matter, which subject matter is defined solely by the attached claims, as may be amended during prosecution.

Like reference symbols in the various figures indicate like elements. Unless otherwise indicated, all figures and drawings in this document are not to scale and are chosen for the purpose of illustrating different embodiments of the invention. In particular the dimensions of the various components are depicted in illustrative terms only, and no relationship between the dimensions of the various components should be inferred from the drawings.

DETAILED DESCRIPTION

Although terms such as "top", bottom", "upper", lower", "front" and "back", and "first" and "second" may be used in this disclosure, it should be understood that those terms are used in their relative sense only.

Figure 1:
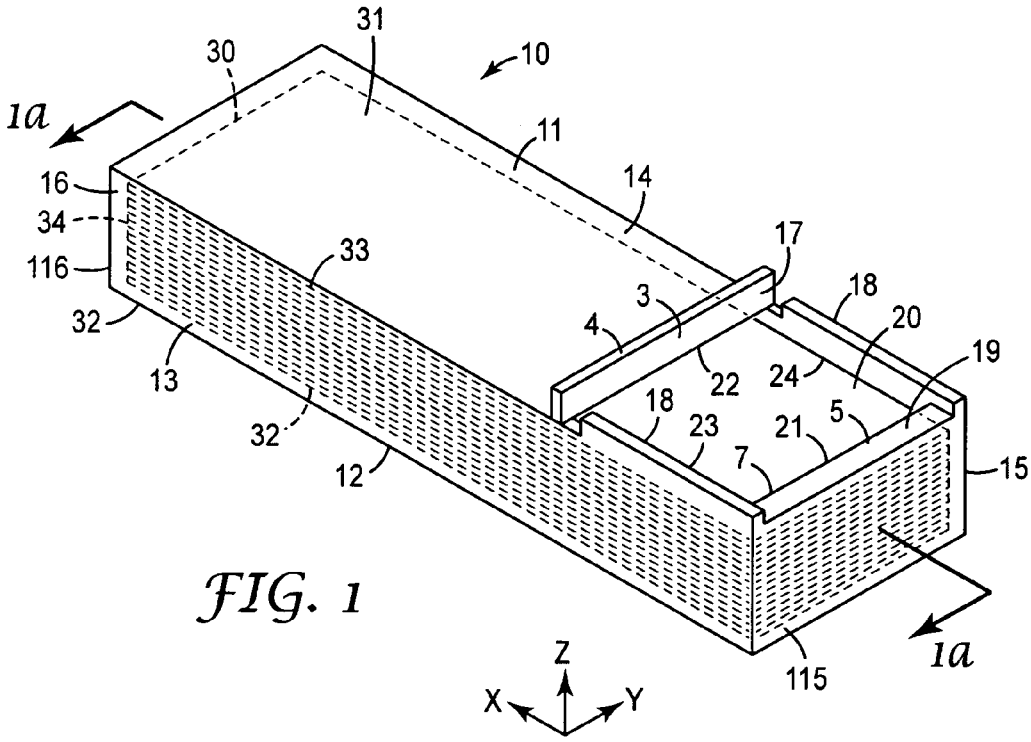
FIG. 1 is a perspective view of an exemplary tab piece storage and attachment unit.
Figure 1A:
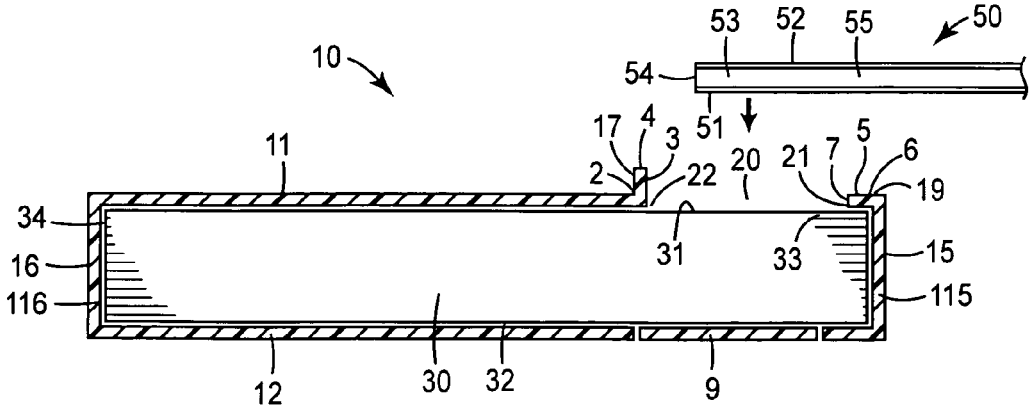
FIG. 1*a* is a cross sectional view of the tab piece storage and attachment unit of FIG. 1, taken along line 1*a* in FIG. 1, and also showing in cross section a length of double-sided adhesive tape.
Figure 2:
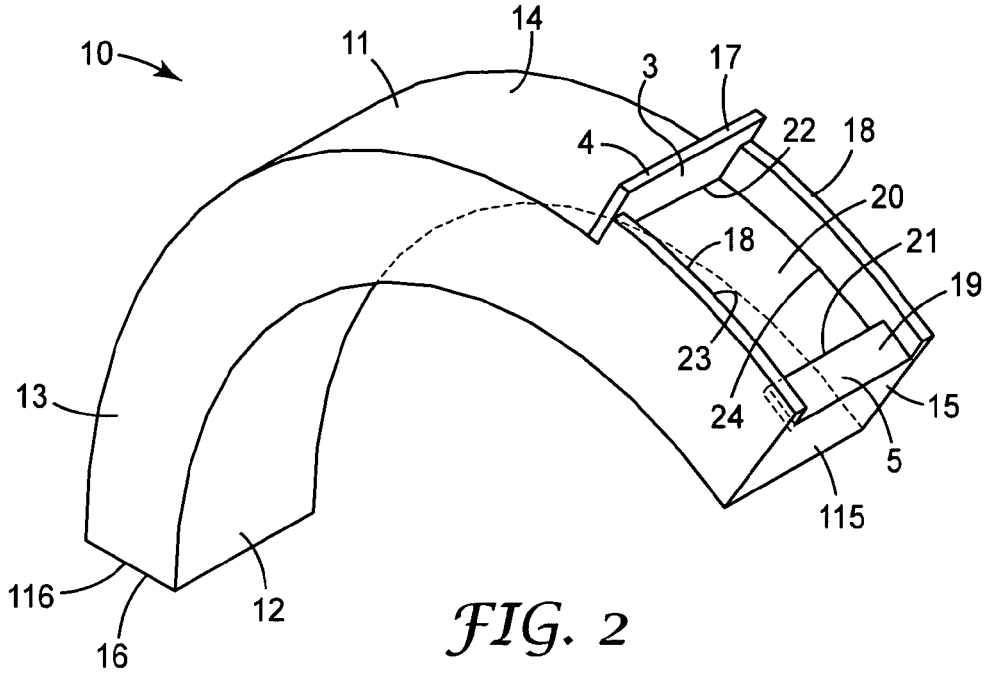
FIG. 2 is a perspective view of an another exemplary tab piece storage and attachment unit.

Herein is disclosed a device comprising a plurality of individual tab pieces arranged in a stack 30 from which individual tab pieces may be removed and attached to a terminal end 53 of an elongate length of double-sided adhesive tape 50. The tab stack 30 is provided in a tab piece storage and attachment unit 10, exemplary illustrations of which are shown in FIGS. 1 and 2. In one embodiment the tab piece storage and attachment unit 10 is elongated and comprises a longitudinal axis (e.g., the axis labeled "x" in FIG. 1) and first end 15 and second end 16. In one embodiment the tab piece storage and attachment unit 10 comprises at least oppositely-facing first major wall 11 and second major wall 12. In one embodiment the first major wall 11 and second major wall 12 are each substantially flat, as illustrated in FIGS. 1 and 1*a*. In another embodiment, first major wall 11 and second major wall 12 are arcuate, such that the unit comprises an arcuate configuration, as illustrated in FIG. 2 (for clarity, tab stack 30 is omitted from FIG. 2). First major wall 11 and second major wall 12 may extend partially, or completely, from first end 15 to second end 16 of tab storage and attachment unit 10.

First major wall 11 comprises an opening 20 (hereafter referred to as a "window") that serves to expose a portion of the first major surface 31 of stack 30 (i.e. the first major surface 31 of uppermost tab piece 33 of the tab piece stack 30), such that terminal end 53 of a length of double-sided adhesive tape 50 can be placed in overlapping relation with window 20 (as shown in FIG. 1*a*). At least a portion of terminal end 53 of tape 50 can be deformed into window 20 such that first major adhesive surface 51 of adhesive tape 50 contacts at least a part of the exposed portion of the first major surface 31 of uppermost tab piece 33 and adheres tab piece 33 to adhesive surface 51. Double-sided adhesive tape 50 can then be withdrawn from proximity to window 20, thereby removing adhered tab piece 33 from tab piece stack 30 while leaving the remaining tab pieces in the tab piece storage and attachment unit 10.

In one embodiment (pictured in FIGS. 1 and 2), window 20 is positioned proximate first end 15 of unit 10. In various embodiments, window 20 comprises a leading edge 21 and a trailing edge 22, each of which is oriented substantially transverse to the elongate length of the unit (that is, with reference to FIG. 1, oriented substantially along the "y" axis of unit 10). Leading edge 21 is herein defined as the edge of window 20 that is nearest to end 15 of unit 10 that window 20 is positioned proximate, and trailing edge 22 is herein defined as the edge of window 20 that is nearest to the end 16 of unit 10 that window 20 is positioned furthest from. Thus, in one embodiment, first major wall 11 extends at least from trailing edge 22 of window 20 to end 16 of unit 10.

Window 20 can also have first side edge. 23 and second side edge 24, that are substantially aligned with the elongate length ("x" axis) of unit 10. In one embodiment, the leading and trailing edge and the side edges are defined by portions of the first major wall 11 of unit 10. In additional embodiments, the various window edges are defined by other elements (e.g. optional components such as side walls, flanges, alignment rails, and/or end stops, as discussed in detail later herein).

In one embodiment (pictured in FIGS. 1 and 2), window 20 is sized so as to occupy a majority of the width (i.e. along the "y" axis of unit 10) of first major wall 11 of the unit. In various embodiments, window 20 extends at least about 60%, 80% or 100% across the width of.first major wall 11 of unit 10. In one embodiment (pictured in FIGS. 1 and 2), window 20 is sized so as to comprise a minority of the length (i.e. along the "x" axis of unit 10) of first major wall 11 of the unit. In various embodiments, window 20 extends at most about 40%, 30% or 20% along the length of the first major wall 11 of unit 10. The positioning of window 20 proximate first end 15 of unit 10, and the sizing of window 20 so as comprise a minority of the length of unit 10, provides that when unit 10 is used to attach a tab to a length of double-sided adhesive tape, the tab will protrude beyond the terminal end of the tape, as will be explained in detail later herein.

Various additional optional features may be provided in order to aid in functioning of the device and method. In one embodiment (pictured in FIGS. 1 and 2), unit 10 comprises an end stop 17 that is positioned proximate trailing edge 22 of window 20. End stop 17 can aid the user in the positioning of terminal end 53 of the double-sided tape 50 in overlapping relation with window 20 (for example, by abutting terminal edge 54 of the length of tape 50 against major surface 3 of end stop 17). In one embodiment, end stop 17 is aligned with trailing edge 22 of window 20. In a further embodiment, end stop 17 defines trailing edge 22 of window 20. In one embodiment, end stop 17 is positioned substantially parallel to the width of unit 10 (i.e. along short axis "y"). In one embodiment, end stop 17 protrudes above (i.e. in the "z" direction of FIG. 1) first major wall 11.

In one embodiment (pictured in FIG. 1*a*), end stop 17 comprises major surface 3 that is generally flat along the "y" axis of unit 10, and that is positioned substantially normal to the plane of first major wall of the unit. In an alternative embodiment, end stop 17 is positioned such that distal end 4 of end stop 17 is closer to leading edge 21 of the window than is proximal end 2 of end stop 17. In such a case, surface 3 of end stop 17 can be substantially flat; alternatively, surface 3 of end stop 17 can be arcuate. In one embodiment, unit 10 comprises at least one alignment rail 18 proximate window 20. Such an alignment rail 18 can be useful in positioning the length of tape 50 with reference to the "y" axis of unit 10. In one embodiment alignment rail 18 is positioned proximate a first side edge 23 of window 20 and is substantially aligned with side edge 23. In a further embodiment, alignment rail 18 defines side edge 23. In one embodiment, alignment rail 18 extends beyond (e.g., protrudes above) first major wall 11 of unit 10. In use, a side edge 55 of the length of double-sided tape 50 can be positioned proximate (e.g. abutted against) rail 18 for proper placement of the tape relative to window 20, in the "y" direction.

In one embodiment (pictured in FIGS. 1 and 2), two alignment rails 18 are provided, comprising a first rail 18 proximate first side edge 23 of the window, and a second rail 18 proximate second side edge 24 of the window, such that a length of double-sided adhesive tape 50 can be guided therebetween. In one embodiment, rails 18 rails extend beyond (e.g., protrude above) first major wall 11 of unit 10. In one embodiment, rails 18 are parallel to each other. In another embodiment, rails 18 are positioned at an angle to each other with rails 18 farther apart proximate leading edge 21 of window 20, and with rails 18 closer together proximate trailing edge 22 of window 20, to aid in guiding the length of tape 50 between rails 18.

In one embodiment (pictured in FIGS. 1 and 2), unit 10 comprises a flange 19 positioned proximate leading edge 21 of window 20. Flange 19 can be useful in securing the tab piece stack 30 within the unit, such that tab pieces do not accidentally fall out of window 20. In one embodiment, distal end 7 of flange 19 defines leading edge 21 of window 20. In various embodiments, flange 19 may be attached to major wall 11 of unit 10, and/or to one or more side walls of unit 10. In various embodiments, flange 19 can be positioned substantially aligned with the plane of first major wall 11 of unit 10 (as in FIGS. 1 and 2); or, flange 19 can be angled such that distal end 7 of flange 19 is slightly closer to second major surface 12 of unit 10 (i.e., along the "z" axis), than is proximal end 6 of flange 19.

Flange 19 should be thick enough (along the "z" axis) to be mechanically strong, yet it should not be so thick that it makes it difficult to deform adhesive tape 50 sufficiently far into window 20 to contact the first major surface 31 of uppermost tab piece 33. Accordingly, in various embodiments the thickness of flange 19 thickness at distal end 7 is about at most 1 mm, 0.5 mm, or 0.2 mm. In one embodiment, flange 19 is tapered such that its thickness at distal end 7 is less than its thickness at proximal end 6.

As mentioned above, flange 19 should be sized and positioned so as to be in overlapping relation with tab piece stack 30 to a sufficient extent to prevent the tab pieces from falling out of window 20. Thus, in various embodiments the distance from flange proximal end 6 to flange distal end 7 is at least about 0.5, 1.0 or 1.5 mm. However, flange 19 should not comprise such a large area as to unduly increase the likelihood of adhesive tape 50 becoming attached to flange 19 in the event that tape adhesive surface 51 comes in contact with flange surface 5 in use of the device. Thus, in various embodiments the distance from flange proximal end 6 to flange distal end 7 is at most about 5, 4, or 3 mm.

Flange 19 may extend across the entirety of the width of window 20 (in the "y" direction), or, it may only extend across a portion of the width of window 20. In one embodiment, multiple small flanges may be used (e.g., so as to comprise a comb configuration). In one embodiment, flange major surface 5 can be provided or treated so as to minimize the ability of first major adhesive surface 51 of tape 50 to adhere to surface 5. For example, flange 19 can comprise a low surface energy material (e.g. a fluoropolymer) or can be coated, treated, etc., with a surface energy lowering treatment.

Tab piece storage and attachment unit 10 is adapted to receive and store a stack 30 of individual tab pieces, and to facilitate the attachment of individual pieces to a length of double-sided tape 50. Accordingly, unit 10 may define a compartment that partially or substantially encloses the tab stack, except for window 20 portion discussed in detail above. As such, in addition to first major wall 11 and second major wall 12, unit 10 may comprise one or more side walls 13 and 14, and/or one or more end walls 115 and 116 (as shown in the exemplary illustrations of FIGS. 1, 1*a*, and 2).

Side walls and/or end walls, if present, may be oriented substantially normal to the plane of major walls 11 and 12 (such a configuration is shown in the exemplary illustrations of FIGS. 1 and 2). In some embodiments, a side wall or walls and/or an end wall or walls, may not be present. For example, first and second major walls 11 and 12 may be designed to extend beyond one or both side edges and/or end edges of the tab stack, with the various edges of first and second major walls being bonded together (e.g. by heat sealing, ultrasonic bonding, etc.). In this case some portion or all of the perimeter of unit 10 may be enclosed to more securely contain the tab stack, even though true side walls may not be present.

In one embodiment, tab stack 30 is held within unit 10 primarily by the pressure applied by a biasing element 9 as described below. In such a case, it may not be necessary to provide side walls, end walls, etc., although such elements can still be included if desired.

In one embodiment, tab piece stack 30 is positioned between first major wall 11 and second major wall 12 of unit 10 such that first major surface 31 of the tab stack (i.e. the first major surface 31 of uppermost tab piece 33 in the tab stack) is proximate first major wall 11, and second major surface 32 of the tab stack is proximate second major wall 12. In one embodiment (pictured in FIG. 1*a*), second major wall 12 of unit 10 comprises biasing element 9 arranged to press against second major surface 32 of tab stack 30 so as to urge and maintain the tab stack in the direction of first major wall 11 of unit 10 (so as to position tab stack 30 such that the first major surface 31 of tab stack 30 is proximate window 20 in first major wall 11). In various embodiments, biasing clement 9 can be provided as part of second major wall 12, can replace part of major wall 12, can be attached to major wall 12, can reside atop (i.e. upwards along the "z" axis), major wall 12, etc.

Figure 3:
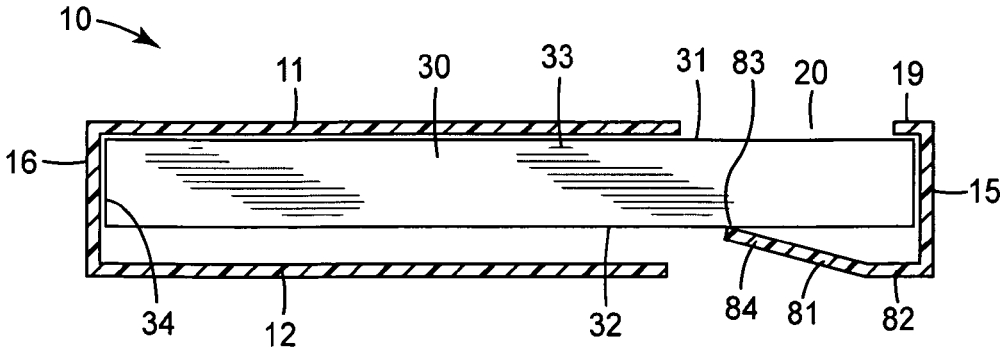
FIG. 3 is a side view of an exemplary tab piece storage and attachment unit comprising an exemplary biasing element.

In one embodiment, biasing element 9 comprises a piece of resilient material such as a compressible foam (e.g. foam rubber), a piece of intrinsically resilient solid material (e.g. rubber, silicone, etc.), and the like. The resilient material can be backed by a solid material if desired. In an alternative embodiment, biasing element 9 comprises a platen (e.g. a piece of solid material) backed by a spring. In still another alternative embodiment (pictured in FIG. 3), biasing element 9 comprises a leaf spring 81. Leaf spring 81 can comprise a member 84 made of stiff, resiliently flexible material, that is fixed at proximal end 82 (e.g., attached to a portion of major wall 12 of unit 10) and free at a distal end 83, with distal end 83 being positioned closer to first major wall 11 than is proximal end 82. Tab stack 30 can be loaded into unit 10 during momentary application of a deforming force that urges distal end 83 of leaf spring 81 toward the plane of second major wall 12. After loading of tab stack 30 into unit 10 and removal of the deforming force, distal end 83 of leaf spring 81 will subsequently attempt to return to its original position and will thus urge and maintain tab stack 30 in the direction of first major surface 11 of unit 10. In a particular embodiment, leaf spring 81 comprises a molded plastic member 84 that is integrally formed with second major wall 12 of unit 10, and/or a side wall or end wall of unit 10, by way of being molded along with the wall.

Biasing element 9 can comprise a portion of, or the entirety of, second major wall 12 of unit 10. In a particular embodiment, biasing element 9 serves to apply pressure preferentially to the portion of tab stack 30 that is proximate window 20 rather than to the entirety of the tab stack. Biasing element 9 should be constructed so as to apply appropriate force to tab stack 30 so as to position uppermost tab piece 33 for attachment, but should not apply such force that it is difficult to remove tab piece 33 from unit 10. In one embodiment, biasing element 9 is manually operable or adjustable by the end user such that the force can be lowered or released when it is desired to remove uppermost tab piece 33 from tab stack 30.

Tab piece storage and attachment unit 10 may be produced in any suitable way. For example, the unit may comprise two mating pieces that fit together and attach by mechanical means such as snap-fitting, clamping, etc., or by methods such as solvent bonding, adhesive bonding, etc. Or, unit 10 may be produced (e.g. molded) as a unitary piece. Various pieces (side walls, end walls, end stop, flange, alignment rails, etc.) may be produced separately and attached to unit 10, or may be integral to the unit (e.g. molded therewith). Unit 10 may be designed so as to come apart (e.g. the first major wall 11 and second major wall 12 may come apart from each other); or, certain pieces (e.g. a side wall) may be removable, so as to allow for refilling of a new tab piece stack 30. Any or all of the surfaces of the various components and elements that may come in contact with an adhesive surface of the tape (including particularly flange major surface 5) can be treated with a low energy treatment so as to minimize the likelihood of the adhesive surface of the tape sticking to that surface.

Tab piece storage and attachment unit 10 is sized so as to contain and dispense tabs that are of appropriate length so as to provide a useful pull tab for a stretch releasing adhesive tape. That is, the formed tab should have sufficient bonded area to first major surface 51 and second major surface 52 of tape 50 that the tab does not detach from tape 50. In addition, the formed tab should protrude sufficiently far beyond terminal edge 54 of the tape as to be easily graspable by a user. In various embodiments, the tab/tape bonded area on each major surface of tape 50 should extend along the elongate length of tape 50 least about 4 mm, 8 mm, or 12 mm from terminal edge 54 of tape 50. In various embodiments, the formed tab should protrude at least about 5, 10 or about 15 mm beyond terminal edge 54 of tape 50. Thus, in various embodiments, unit 10 should be sized so as to be able to contain tabs of at least about 13, 26 or 39 mm in length.

Unit 10 is sized so as to contain and dispense tab pieces that are of appropriate width. In most cases, the width of the tab should be chosen to approximately equal that of the double-sided adhesive tape with which the tab is to be used. Accordingly, in various embodiments the tab storage unit is sized so contain tabs of about ½ inch, about ¾ inch, or about 1 inch in width.

Tab piece storage and attachment unit 10 serves to contain stack 30 of individual tab pieces. In one embodiment, stack 30 is loaded into unit 10 at the factory, before delivery of the unit to a user. In an additional embodiment, tab refills may be provided such that the end user can deposit additional tab pieces in the unit. In this case, unit 10 may have at least one open or openable side wall, for example to allow for easy refilling of unit 10 with additional tab pieces.

Tab storage and attachment unit 10 can be used to attach a protruding tab to a length of double-sided adhesive tape 50; e.g., to a length of stretch releasing adhesive tape. Length of double-sided adhesive tape 50 can comprise a length that is suitable for the bonding operation to be performed; alternatively, tape 50 can comprise a longer length (e.g., a roll) from which a shorter length of tape, suitable for the bonding operation to be performed, is separated (e.g., by a cutting process described later in detail) after attachment of the protruding tab. Length of tape 50 comprises a terminal end 53 that comprises a terminal edge 54, and first major adhesive surface 51 and second major adhesive surface 52. If present on first major surface 51, release liner is removed to expose first major adhesive surface 51 at least at terminal end 53. The length of tape 50 is positioned such that terminal end 53 of tape 50 is in overlapping relation with window 20 (as shown in FIG. 1*a*). In one embodiment, this is performed with terminal edge 54 of tape 50 aligned with trailing edge 22 of window 20. In a particular embodiment, terminal edge 54 of tape 50 is abutted against surface 3 of end stop 17 in performing this operation. In another embodiment, one side edge 55 of the length of tape 50 is aligned with an alignment rail 18 that is positioned proximate a side edge of window 20 in performing this operation. In a specific embodiment, the side edges of the length of tape 50 are positioned against alignment rails 18 that are positioned proximate side edges 23/24 of window 20.

Once tape 50 is properly positioned, at least a portion of the area of second major surface 52 at terminal end 53 of tape 50 that is in overlapping relation with window 20, is depressed so as to deflect at least that portion of tape 50 into window 20 so that first major adhesive surface 51 of tape 50 contacts first major surface 31 of uppermost tab piece 33 of tab stack 30. Such a procedure may be carried out manually, e.g. by use of the finger of the user; alternatively, a fixture or other suitable device may be provided in association with unit 10, by which the user can carry out this operation. The procedure can be carried out by applying pressure directly to second major surface 52; or, by applying pressure to a release liner (or other layer) that is positioned atop major surface 52. Regardless of how carried out, this procedure results in an area of first major adhesive surface 51 of tape 50 coming in contact with the first major surface 31 of uppermost tab piece 33 of tab stack 30 to a sufficient extent to attach tab piece 33 to tape adhesive surface 51. Then, tape 50 is removed from proximity to window 20 (e.g. by moving the tape upwards along axis "z" normal to the plane of window 20) with the result that the attached tab piece 33 passes through window 20 and is removed from unit 10.

Figure 4:
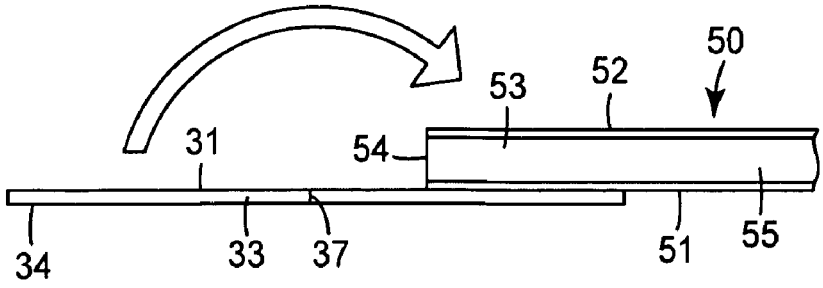
FIG. 4 is a side view of a length of double-sided adhesive tape with a tab piece attached to a terminal end.

The result of this operation is the attachment of tab piece 33 to first major surface 51 of terminal end 53 of a length of double-sided adhesive tape 50, with the distal end 34 of tab piece 33 protruding beyond terminal edge 54 of terminal end 53 of the tape (as shown in FIG. 4). If a release liner is present on second major adhesive surface 52 of tape 50, at this time the release liner is removed from surface 52 at least at terminal end 53. Then, distal end 34 of the protruding portion of tab piece 33 is wrapped around terminal end 53 of the tape (e.g., by wrapping it around terminal edge 54 of terminal end 53 of tape 50 as shown in FIG. 4). Then, an area of major surface 31 of distal end 34 of tab piece 33 is contacted with, and bonded to, second major adhesive surface 52 of terminal end 53 of adhesive tape 50. In carrying out this procedure, distal end 34 of tab piece 33 is positioned on second major adhesive surface 52 so as to provide sufficient bonding area (e.g., such that the tab/tape bonded area on second major adhesive surface 52 of tape 50 is of similar size to the tab/tape bonded area on first major adhesive surface 51 of tape 50). The proper placement of tab piece 33 distal end 34 on second major adhesive surface 52 of tape 50 can be estimated visually by the user; alternatively, the length of tape 50 may be placed in overlapping relation to window 20 (with second major surface 52 now facing the user) to aid in accurate placement.

To aid the user in wrapping and placing a tab piece, the tab piece may be provided with a crease 37 that is located approximately midway along the longitudinal axis of the tab piece, and oriented transversely to the longitudinal axis of the tab piece. The presence of crease 37 makes it easier for the user to wrap tab piece 33 such that an appropriately sized area of distal end 34 of tab piece 33 is placed into overlapping relation with adhesive surface 52 of tape 50 for bonding. Such a crease may comprise a linear zone in which the tab film material has been treated (e.g. weakened, perforated, ablated, etc.) so as to provide the tab film with a tendency to fold preferentially along the linear zone. Or, such a crease may comprise a linear zone in which the film material has been biased (folded, crimped, etc.) so as to provide the tab film with a tendency to fold preferentially along the linear zone, in a particular direction.

With the bonding of the distal end 34 of tab piece 33 to second major adhesive surface 52 of tape 50, a length of double-sided adhesive tape with a tab attached to both major surfaces of the terminal end of the adhesive tape, and protruding past the terminal edge of the terminal end of the tape, is provided. In one embodiment, the same major surface 31 of tab piece 33 is attached to both major adhesive surfaces 51 and 52 of double-sided adhesive tape 50.

In one embodiment, length of tape 50 comprises a discrete length, suitable for the bonding operation to be performed, when the above-described tab attachment procedure is carried out. In an alternative embodiment, the above-described procedure is carried out with double-sided adhesive tape 50 present as a longer length (e.g., as a roll). In this embodiment, the desired length of tape 50 (with attached protruding tab as described), suitable for the bonding operation to be performed, is then separated from the longer length of tape. Such a separation process may he carried out by use of a cutting device (e.g. scissors, knife, blade, guillotine, etc.). In one embodiment, a cutting device 27 (e.g. scissors, knife, blade, guillotine, etc.) is provided as part of, or attached to, tab storage and attachment unit 10. Cutting device 27 may be provided at any convenient location on tab storage and attachment unit 10. If desired, the cutting device can comprise a retractable or removable cover by which the blade can be shielded when not in use.

The tab pieces as disclosed herein typically comprise a longitudinal axis and a short axis and can be comprised of any film material with at least one adherable surface and which is sufficiently strong as to form a usable tab. In one embodiment, a multiplicity of tab pieces are combined to form a stack 30 to be placed in the tab piece storage and attachment unit 10, with the adherable surface of each tab piece oriented toward window 20 in unit 10. Thus, the first major surface 31 of each tab piece (which will be the surface that is bonded to the first and second major adhesive surfaces 51 and 52 of double-sided tape 50) is an adherable surface. An adherable surface refers generally to a surface that is capable of bonding to a pressure-sensitive adhesive (such as those typically used in double-sided adhesive tapes, and particularly in stretch releasing adhesive tapes, and described in further detail in, e.g. U.S. Pat. No. 5,516,581 to Kreckel et. al.) such that the tab is not removable from the pressure sensitive adhesive, or is not removable without damaging the adherable surface of the tab film, the tab film material, the pressure sensitive adhesive of the stretch releasing tape, or the elastic backing (if present) of the stretch releasing tape. As such, an adherable surface may comprise any surface that does not comprise a release liner as described above. That is, an adherable surface refers to a surface that does not comprise a release coating, low adhesion backsize, treatment or ingredient such as a silicone or silicone containing material, a fluorinated or fluorine-containing material, a fluorosilicone material, or the like. Representative examples of materials suitable for tab films include polyolefins, such as polyethylene, including high density polyethylene, low density polyethylene, linear low density polyethylene, and linear ultra low density polyethylene, polypropylene, and polybutylenes; vinyl copolymers, such as polyvinyl chlorides, both plasticized and unplasticized, and polyvinyl acetates; olefinic copolymers, such as ethylene/methacrylate copolymers, ethylene/vinyl acetate copolymers, acrylonitrile-butadiene-styrene copolymers, and ethylene/propylene copolymers; acrylic polymers and copolymers; and combinations of the foregoing. Polyester based materials (e.g. poly(ethylene terephthalate), poly(butylene terephthalate), etc.) may also be used. Mixtures or blends of any plastic or plastic and elastomeric materials such as polypropylene/polyethylene, polyurethane/polyolefin, polyurethane/polycarbonate, polyurethane/polyester, can also be used. Cellulosic films (e.g. paper, cellophane, etc.) can also be used. Tab films can also be prepared from filled materials, such as, for example, filled films, e.g., calcium carbonate filled polyolefins. Tab films can be made by any known method of film forming, such as, for example, extrusion, co-extrusion, solvent casting, and the like. Clear films may be preferred for many applications.

The tab film material should have sufficient thickness and strength so as to not break or tear when the tab formed therefrom is gripped and pulled. That is, the tab film material should survive the force used to activate the stretch release property of the stretch releasing adhesive tape. In various embodiments, the tab film can be at least about 12 microns in thickness. The tab film should not however be so thick as to be difficult to handle. In various embodiments, the tab film is at most about 75 microns or 150 microns in thickness.

The adherable surface of the tab film material may be treated to improve its ability to adhere to the adhesive surface of the stretch releasing adhesive tape. For example, corona discharge, plasma discharge, flame treatment, electron beam irradiation, ultraviolet radiation, chemical vapor deposition, acid etching, or chemical priming may be used. In one embodiment, a pressure sensitive adhesive is disposed on the tab film adherable surface to improve adhesion.

It may not be necessary that the other surface of the tab film be adherable as defined herein. However, this other surface should be readily graspable by the user, and may comprise a treatment (roughened surface, etc.) so as to provide enhanced grippability. Other treatments may be used as desired, as discussed in detail later herein.

In various embodiments, either or both of the adherable surface and the graspable surface may be treated in specific areas so as to provide different properties in different areas of that surface, e.g. by stripe coating, pattern coating, and the like. For example, areas of higher adhesion properties (achieved by priming, or by coating adhesive, etc.) may be provided. Instead of this, or in addition to this, areas of lower adhesion properties (achieved by coating release agents, etc.) may be provided.

In various embodiments, tab film pieces can be provided with a crease, as described above in detail.

Double-sided adhesive tape 50 can be any suitable tape that comprises adhesive on first major surface 51 and second major surface 52. In one embodiment, double-sided adhesive tape 50 comprises a stretch releasing adhesive tape. A suitable stretch releasing adhesive tape can comprise an elastic backing, or a highly extensible and substantially inelastic backing, with a pressure-sensitive adhesive disposed (e.g. coated) thereupon. Or the tape can be formed of a solid, elastic pressure sensitive adhesive. Thus, in this context, the term "tape" encompasses products that comprise a unitary, integral, or solid construction of adhesive (in addition to products that comprise a backing with separate layers of adhesive residing thereupon). Suitable stretch releasing tapes are described in U.S. Pat. No. 4,024,312 to Korpman; German Patent No. 33 31 016; U.S. Pat. No. 5,516,581 to Kreckel et al.; and PCT International Publication No. WO 95/06691 to Bries et al.

One or both adhesive surfaces 51 and 52 can be supplied covered with a liner, i.e. a release liner, present. The liner or liners can be any conventional readily removable liner. Typical liners include a backing formed of, for example, paper, or a polymeric film such as polyethylene, polypropylene, or polyester, which is coated with a release agent such as a silicone, a fluorochemical, or any other conventionally known coating (for example, those coatings known in the art as low adhesion backsizes) that renders the surface substantially nonadhesive. An often preferred liner is silicone coated paper. Often, a liner with release agent present on both major surfaces is used with stretch releasing adhesive tapes, such that if the length of stretch releasing adhesive tape comprises a roll, one surface of the liner contacts adhesive surface 51, and the other surface of the liner contacts adhesive surface 52. In such a case only one such release liner need be used. As discussed above, such a liner or liners are typically removed when it is desired to bond the stretch releasing adhesive tape to an object or objects.

In one embodiment, tab piece storage and attachment unit 10 is provided as a unit that is not associated with the double-sided adhesive tape. In an alternate embodiment, unit 10 is provided in combination with the double-sided adhesive tape. In a particular embodiment, double-sided adhesive tape 50 (either in roll form as a collection of discrete lengths) and tab piece storage and attachment unit 10 are provided together as a kit (for example, packaged together). In a further embodiment, tab piece storage and attachment unit 10 is attached to the frame 41 of a suitable double-sided adhesive tape dispenser 40.

Figure 5:
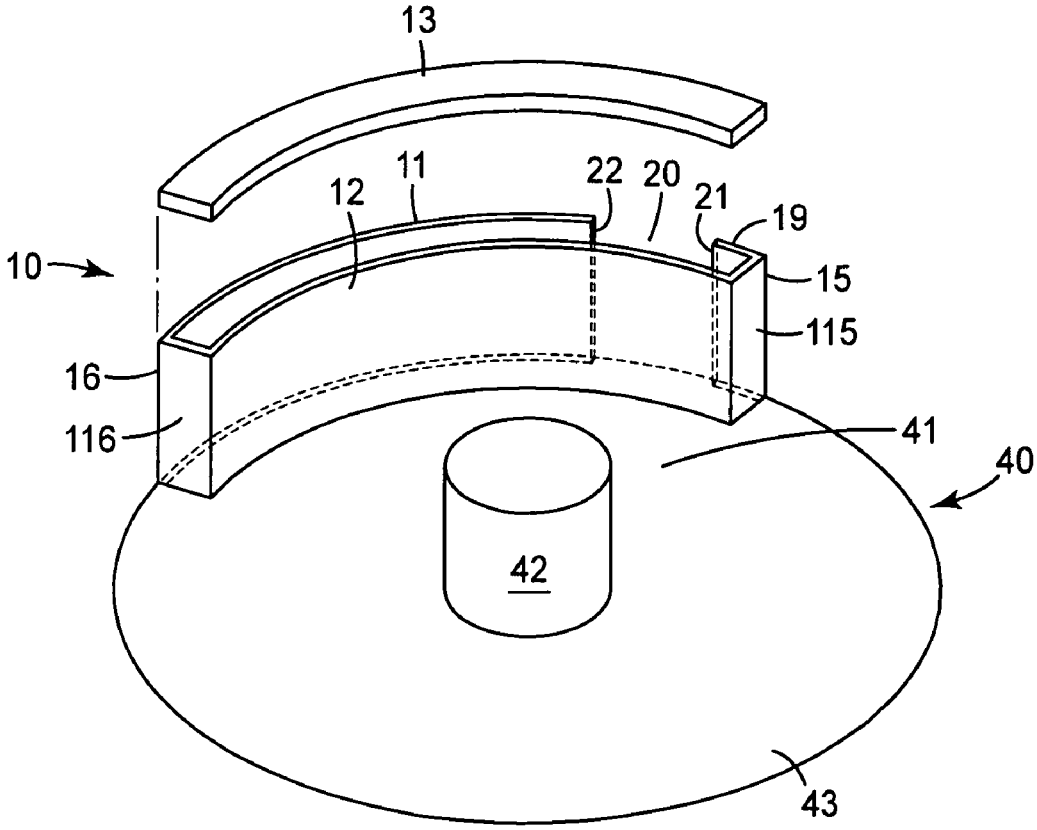
FIG. 5 is an exploded perspective view of an exemplary tape dispenser comprising a tab piece storage and attachment unit.
Figure 10:
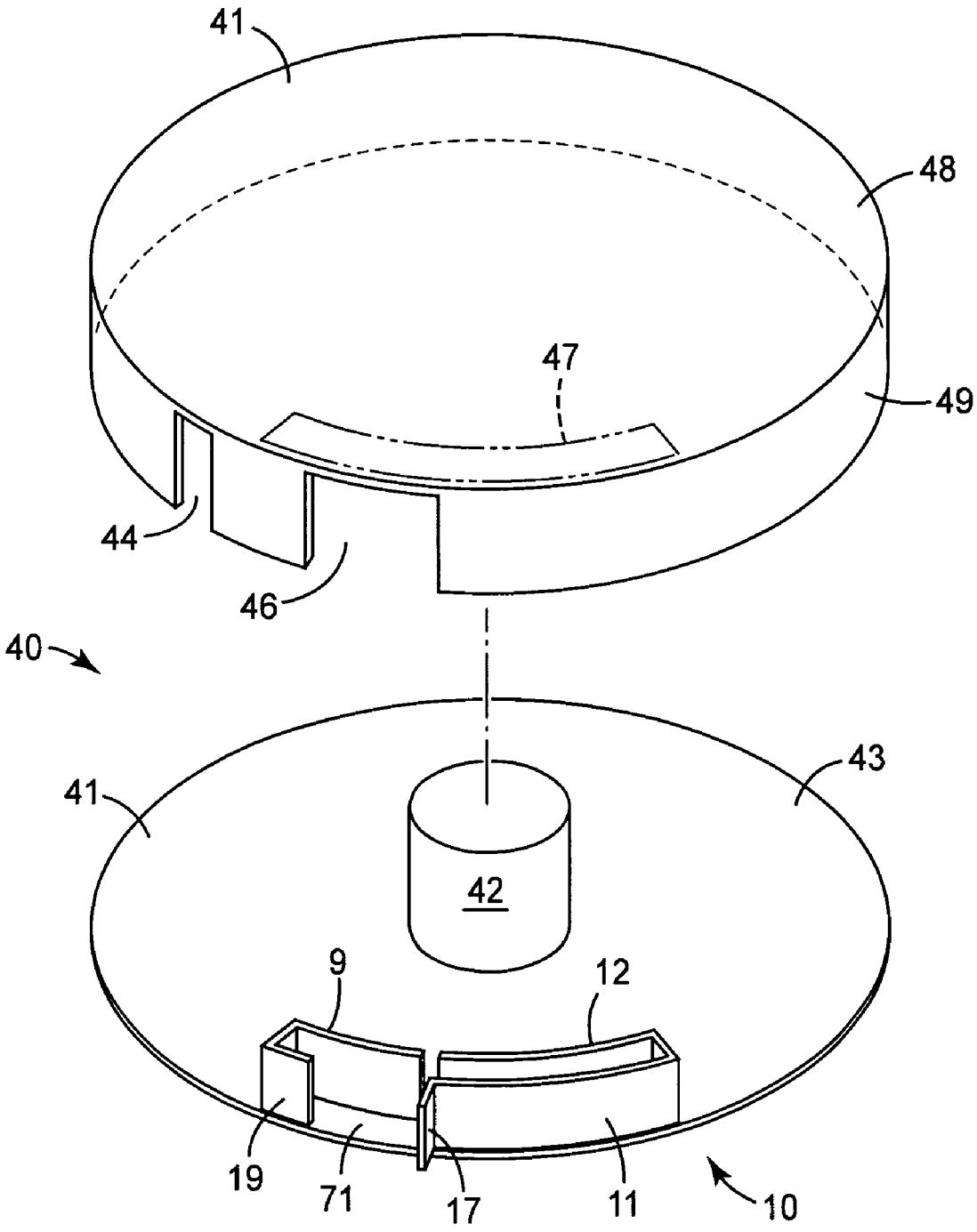
FIG. 10 is an exploded perspective view of an exemplary tape dispenser comprising a tab piece storage and attachment unit.

With reference to the exemplary embodiment of FIG. 5, herein is disclosed a dispenser 40 comprising a frame 41. A roll of double-sided adhesive tape 50 (omitted for clarity in FIG. 5) can be positioned on frame 41. In the exemplary embodiment of FIG. 5, optional hub 42 is provided for receiving roll of tape 50. In such a configuration, roll of tape 50 can be wound directly on hub 42; or, roll 50 can be wound on a core which is itself slidably mountable onto hub 42. If present, hub 42 may comprise an axial dimension that is similar to the width of the roll of tape to be mounted thereupon (as in the exemplary illustrations of FIGS. 5 and 10). Or, the axial dimension of hub 42 can be much smaller (e.g., hub 42 can be a stub or flange). In an alternative embodiment, no hub may be present. In such a case, roll 50 can be held in the desired position in some other manner. For example, if frame 41 comprises a housing (such as illustrated in the exemplary embodiment of FIG. 10 and discussed later herein) that partially, substantially or completely encloses roll of tape 50, roll of tape 50 can be held in place within the housing, without the use of a hub.

Dispenser 40 further comprises tab piece storage and attachment unit 10 attached to frame 41, unit 10 containing individual tab pieces arranged in a stack 30 (omitted from FIG. 5 for clarity) comprising first major surface 31 and second major surface 32 and described above in detail. Tab piece storage and attachment unit 10 comprises an elongated shape with first end 15 and second end 16, and comprising at least first and second major opposing walls 11 and 12, and wherein first major wall 11 comprises a window 20 that is proximate first end 15 of elongated storage and attachment unit 10 and that exposes at least a portion of first major surface 31 of tab piece stack 30.

In one embodiment of dispenser 40, frame 41 comprises a member or members that connect to tab piece storage and attachment unit 10. Frame 41 may connect (optional) hub 42 (from one or both axial ends of hub 42) to tab piece storage and attachment unit 10. In such an embodiment, roll of tape 50 may be substantially exposed. In another embodiment, (pictured in FIG. 5), frame 41 comprises at least one side wall 43 to which optional hub 42 and unit 10 are attached. In this case side wall 43 may partly, substantially or completely cover at least one axial surface of roll 50. In another embodiment, discussed later in detail, frame 41 comprises a housing that comprises at least a first and second side wall and that partially, substantially, or completely encloses roll of tape 50.

In use of dispenser 40, terminal end 53 of tape 50 (not shown in FIG. 5) can be positioned in overlapping relation to window 20 of tab piece storage and attachment unit 10, and a tab piece 33 attached to terminal end 53 of tape 50, according to the procedure described in detail above.

Figure 6:
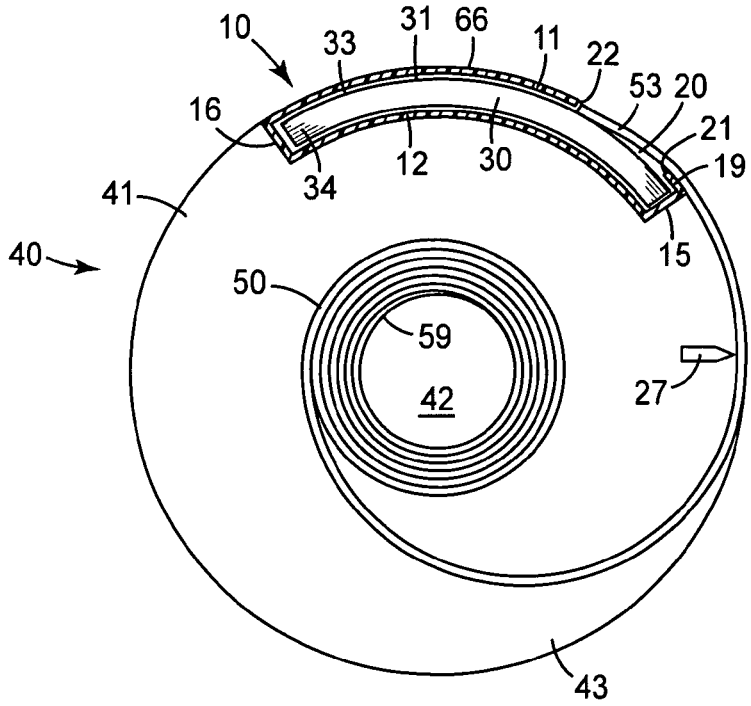
FIG. 6 is a top plan view of an exemplary tape dispenser comprising a tab piece storage and attachment unit, and comprising a roll of tape and a tab piece stack.
Figure 7:
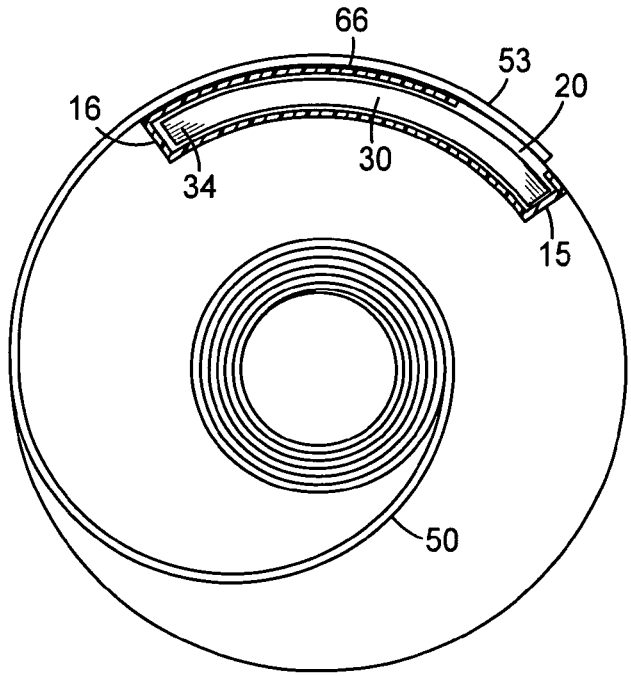
FIG. 7 is a top plan view of an exemplary tape dispenser comprising a tab piece storage and attachment unit, and comprising a roll of tape and a tab piece stack.
Figure 8:
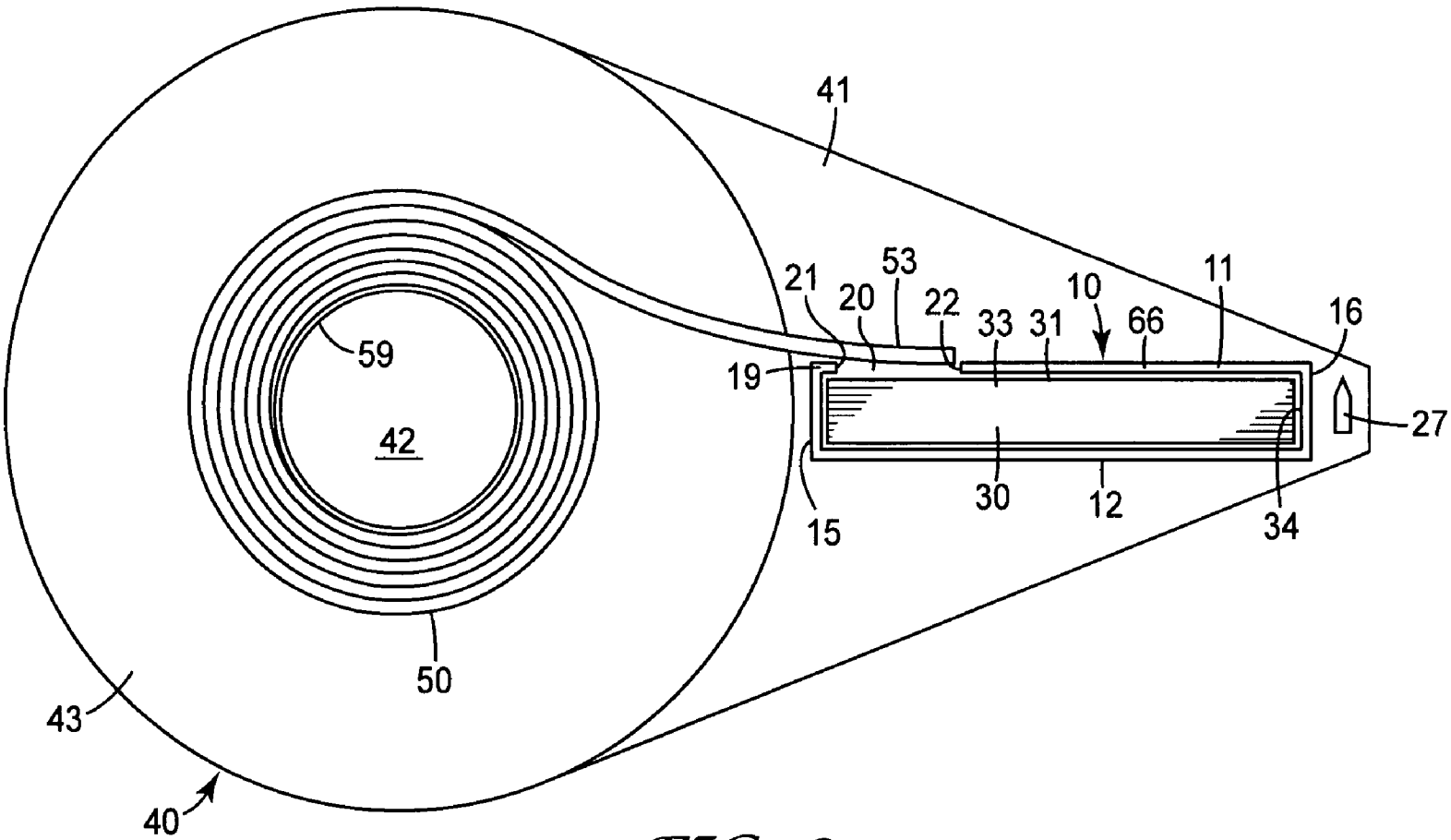
FIG. 8 is a top plan view of an exemplary tape dispenser comprising a tab piece storage and attachment unit, and comprising a roll of tape and a tab piece stack.
Figure 9:
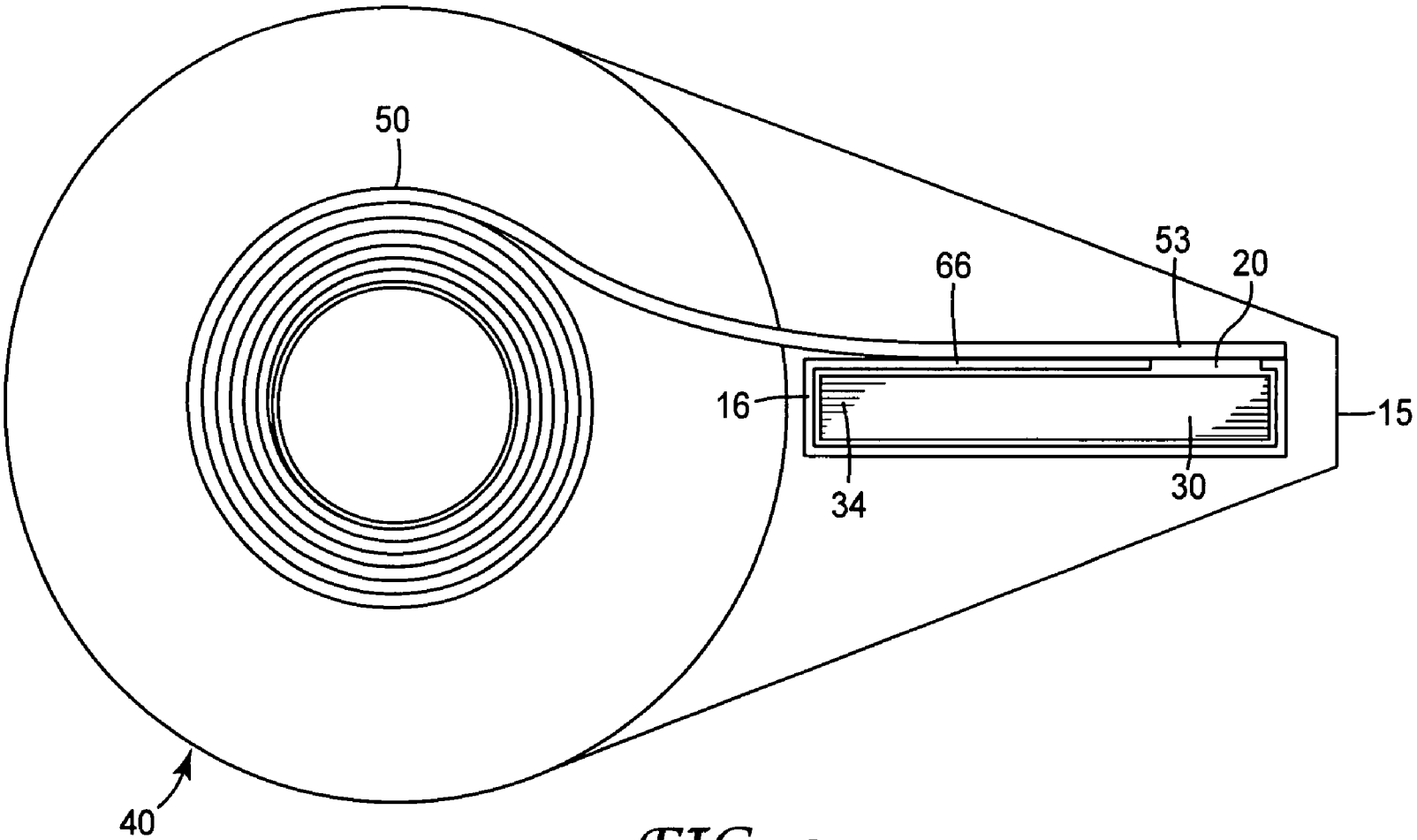
FIG. 9 is a top plan view of an exemplary tape dispenser comprising a tab piece storage and attachment unit, and comprising a roll of tape and a tab piece stack.

In one embodiment of dispenser 40, tab piece storage and attachment unit 10, and roll of tape 50, are arranged such that when the terminal end 53 of tape 50 is positioned in overlapping relation with window 20, no portion of tape 50 is in overlapping relation with the non-window portion 66 of major surface 11 of the storage and attachment unit (that is, portion 66 of major surface 11 that is between end 16 of unit 10 and trailing edge 22 of window 20). Such an arrangement is shown in FIGS. 6 and 8. (in this context, the term "overlapping relation" with reference to an item relative to a surface of a wall means that the item is adjacent the wall surface with no portion of the body of the wall being between the item and the surface). Such a configuration is contrasted with an arrangement in which, when terminal end 53 of tape 50 is positioned in overlapping relation with window 20, at least a portion of tape 50 is in overlapping relation with the non-window portion 66 of major surface 11 of storage and attachment unit 10 (such a contrasting arrangement is shown in FIGS. 7 and 9.)

In the embodiments pictured in FIGS. 6 and 8, no portion of tape 50 is in overlapping relation with any portion of tab stack 30 other than the portion of tape 50 that is in overlapping relation with window 20 (and with flange 19 if present). Thus, end 34 of uppermost tab piece 33 protrudes beyond terminal edge 54 of the length of double-sided adhesive tape 50. Thus, upon attachment of the uppermost tab piece 33 to terminal end 53 of the length of tape 50, distal end 34 of newly attached tab piece 33 will protrude beyond terminal edge 54 of length of tape 50 (i.e. will form a configuration similar to that shown in FIG. 4). Such a condition allows distal end 34 of the tab piece to be wrapped around the terminal end 53 of the tape 50 so as to form a length of double-sided adhesive tape 50 bearing a tab that is attached to both major surfaces 11 and 12 of tape 50 and that protrudes beyond the terminal edge 54 of tape 50. Such a condition is not present with the configurations illustrated in FIGS. 7 and 9 thus these configurations do not allow the formation of a tab that is attached to both surfaces of an adhesive tape and that protrudes far enough past the terminal edge of the tape to serve as a useable protruding pull tab.

In one embodiment, tab piece storage and attachment unit 10 can be positioned such that the longitudinal axis of the unit is substantially parallel to the closest surface of hub 42, as shown in FIG. 6 (if no hub is present, tab piece storage attachment unit 10 can be positioned such that the longitudinal axis of the unit is substantially parallel to the closest inner surface 59 of roll of tape 50). In an alternative embodiment, unit 10 can be positioned such that the longitudinal axis of the unit is substantially normal to the closest surface of the tape hub and/or to the closest inner surface of the roll of tape 50 (as in FIG. 8). In various embodiments, unit 10 can be positioned in between the substantially parallel and substantially normal conditions.

In one embodiment (regardless of whether unit 10 is attached to a dispenser 40), unit 10 is substantially flat as shown in the exemplary embodiments of FIGS. 1, 1*a*, 3, and 8. In an alternative embodiment (again regardless of whether unit 10 is attached to a dispenser 40), unit 10 is curved (that is, first and second major walls 11 and 12 are arcuate in shape), as shown in the exemplary embodiments of FIGS. 2, 5, 6, and 10. In various embodiments (yet again, regardless of whether unit 10 is attached to a dispenser 40), first and second major walls 11 and 12 can be substantially parallel to each other (whether the surfaces are relatively flat or whether they comprise arcuate shapes) or can be relatively nonparallel.

In providing a combined tape dispenser and tab piece storage and attachment unit, many configurations are possible. For example (as shown in the exemplary embodiment of FIG. 10), dispenser frame 41 can comprise first side wall 43 and second side wall 48 that together form a housing. Such a dispenser can be made of two or more mating pieces that fit together (e.g. as shown in the exploded view of FIG. 10). In such a case, various components of tab piece storage and attachment unit 10 may be supplied by the two mating pieces. For instance, in the embodiment of FIG. 10, first and second major walls 11 and 12 of tab piece storage and attachment unit 10 are provided as part of dispenser frame side wall 43, and a side wall of unit 10 is provided by area 47 of dispenser frame side wall 48.

In addition to side walls 43 and 48, dispenser frame 41 can also comprise an outer wall 49 (pictured in the exemplary embodiment of FIG. 10) that combines with side wall 43 and/or side wall 48 to form a housing such that roll of tape 50 (omitted from FIG. 10 for clarity) is partially, substantially or completely enclosed by the housing. In such a case, wall 49 can comprise a slot 44 through which terminal end 53 of tape 50 can be delivered to unit 10 for attachment of a tab. Wall 49 can also comprise an opening 46 (as pictured in FIG. 10) that acts in concert with an opening 71 in first major wall 11 to provide window 20 of tab piece storage and attachment unit 10.

In various embodiments, dispenser frame 41 is made of a single unitary piece comprising tab piece storage and attachment unit 10 in combination with any one of, or any combination chosen from among, side wall 43, side wall 48, and/or wall 49. In a particular embodiment, these components are made by being molded as a unit.

If desired, the dispenser can comprise a cutting device 27 (as described in detail elsewhere herein) for separating a length of tape from the roll. (Again as described earlier, such a separation process can be performed either before, or after, attachment of a protruding tab). Cutting device 27 can be provided as part of, or attached to, tab storage and attachment unit 10 as described previously. Alternatively, cutting device 27 can be provided as part of, or attached to, dispenser frame 41 at any convenient location on dispenser frame 41. If desired, cutting device 27 can comprise a retractable or removable cover by which the blade can be shielded when not in use.

Between uses, free (terminal) end 53 of roll 50 can be tacked down to the exposed surface of an underlying layer of roll 50. Or, a holding surface can be provided at any convenient location on dispenser frame 41, comprising a surface to which terminal end 53 of tape roll 50 can be temporarily adhered until the dispenser is to be used again. Such a holding surface may comprise a low energy surface such that the tape can be easily removed from the holding surface. In another embodiment, terminal end 53 of tape 50 can be placed in overlapping relation with window 20 and deflected so as to bond first major adhesive surface 51 of tape 50 to first major surface 31 of uppermost tab piece 33 of tab stack 30, according to the procedure described in detail earlier herein. Dispenser 40 can then be stored in this condition. When it is desired to dispense a length of tape 50 with a tab attached, the user cuts tape 50 to the desired length and withdraws tape 50 from window 20 to remove uppermost tab 33 from unit 10 (again noting that these operations can be performed in either order). The (newly formed) terminal end 53 of tape 50 is then positioned in overlapping relation with window 20, bonded to (newly exposed) first major surface 31 of tab stack 30, and dispenser 40 again stored in this condition.

A number of embodiments of the invention have been described. Nevertheless, it will be understood that various modifications may be made without departing from the invention. Accordingly, other embodiments are within the scope of the following claims.

What is claimed is:

1. A dispenser comprising:

a frame;

a roll of double-sided adhesive tape positioned on the frame, the roll of tape having a terminal end;

a tab piece storage and attachment unit arranged on the frame, the unit having an elongated shape with first and second ends and comprising at least first and second major opposing walls extending at least partially between the first and second ends, the unit further comprising a plurality of individual tab pieces in a stack comprising first and second opposed major surfaces, wherein the tab piece stack is arranged between the first and second major opposing walls, wherein the first major opposing wall contains a window that is proximate the first end of the tab piece storage and attachment unit and that exposes at least a portion of the first major surface of the tab piece stack, wherein the first major opposing wall further comprises a non-window portion located between the window and the second end of the elongated tab piece storage and attachment unit; and, wherein the tab piece storage and attachment unit and the roll of tape are arranged such that when the terminal end of the tape is positioned in overlapping relation with the window, the tape is not in overlapping relation with the non-window portion of the first major opposing wall of the tab piece storage and attachment unit; and wherein the dispenser is configured so that when a terminal end of the elongate length of double-sided adhesive tape is positioned in overlapping relation with the window, no portion of the tape is in overlapping relation with any portion of the tab piece stack other than the portion of the tape that is in overlapping relation with the window.

2. The dispenser of claim 1 wherein the window comprises a leading edge and a trailing edge, and further wherein the tab piece storage and attachment unit comprises an end stop positioned at the trailing edge of the window.

3. The dispenser of claim 1 wherein the window comprises first and second side edges, and further wherein the tab piece storage and attachment unit comprises at least one alignment rail positioned along a side edge of the window.

4. The dispenser of claim 3 wherein the tab piece storage and attachment unit comprises a first alignment rail positioned along the first side edge of the window and a second alignment rail positioned along the second side edge of the window, and wherein both rails extend beyond the first major opposing wall of the tab piece storage and attachment unit.

5. The dispenser of claim 1 wherein the window comprises a leading edge and a trailing edge, wherein the tab piece storage and attachment unit comprises a flange positioned at the leading edge of the window, and wherein the flange is in overlapping relation with a portion of the first major surface of the tab stack.

6. The dispenser of claim 1 wherein the window comprises a leading edge, a trailing edge, and first and second side edges, and further wherein the tab piece storage and attachment unit comprises a flange positioned at the leading edge of the window, at least one alignment rail positioned along a side edge of the window, and an end stop positioned at the trailing edge of the window.

7. The dispenser of claim 1 wherein the second major wall of the tab piece storage and attachment unit comprises a biasing element arranged to press against the second major surface of the tab piece stack.

8. The dispenser of claim 1 wherein the frame comprises a tape hub with an axis, and wherein the elongated tab piece storage and attachment unit is arranged such that:

the longitudinal axis of the elongated unit is oriented substantially parallel to the axis of the tape hub;

the first and second major opposing walls of the tab piece storage and attachment unit are substantially parallel to each other; and, the first major opposing wall is positioned closer to the tape hub and the second major opposing wall is positioned further from the tape hub.

9. The dispenser of claim 1 further comprising a cutting device arranged on the frame.

10. A device for attaching a protruding tab to a terminal end of an elongate length of double-sided adhesive tape, the device comprising:

a tab piece storage and attachment unit containing a plurality of individual tab pieces arranged in a stack with first and second major surfaces, the tab piece storage and attachment unit having an elongated shape with first and second ends and comprising at least first and second major opposing walls extending at least partially between the first and second ends, wherein the first major opposing wall comprises a window that exposes at least a portion of the first major surface of the tab piece stack, the window defined on all sides by edges, wherein the edges comprise leading and trailing edges that are oriented substantially transversely to the longitudinal axis of the elongated unit, and first and second side edges that are oriented substantially parallel to the longitudinal axis of the elongated unit;

wherein the tab piece storage and attachment unit comprises a flange positioned at the leading edge of the window, wherein the flange is in overlapping relation with a portion of the first major surface of the tab piece stack; and, wherein the tab piece storage and attachment unit is attached to the frame of a double-sided adhesive tape dispenser that is configured so that when a terminal end of the elongate length of double-sided adhesive tape is positioned in overlapping relation with the window, no portion of the tape is in overlapping relation with any portion of the tab piece stack other than the portion of the tape that is in overlapping relation with the window.

11. The device of claim 10 wherein the tab piece storage and attachment unit comprises an end stop positioned at the trailing edge of the window.

12. The device of claim 10 wherein the tab piece storage and attachment unit comprises at least one alignment rail positioned along a side edge of the window.

13. The device of claim 12 wherein the tab piece storage and attachment unit comprises a first alignment rail positioned along the first side edge of the window and a second alignment rail positioned along the second side edge of the window, and wherein both rails extend beyond the first major opposing wall of the tab piece storage and attachment unit.

14. The device of claim 10 wherein at least a portion of the first major wall of the tab piece storage and attachment unit comprises a biasing element arranged to press against the second major surface of the tab piece stack.

15. The device of claim 14 wherein the biasing element comprises a leaf spring.

16. The device of claim 10 wherein the tab piece storage and attachment unit comprises at least one alignment rail positioned along a side edge of the window, and an end stop positioned at the trailing edge of the window.

17. The device of claim 10 further comprising a cutting device arranged on the frame.

* * * * *

UNITED STATES PATENT AND TRADEMARK OFFICE

CERTIFICATE OF CORRECTION

PATENT NO. : 7,980,286 B2
APPLICATION NO. : 11/958564
DATED : July 19, 2011
INVENTOR(S) : Joseph T Bartusiak It is certified that error appears in the above-identified patent and that said Letters Patent is hereby corrected as shown below:

Column 13

Line 49, delete "(in" and insert -- (In --, therefor.

Signed and Sealed this
Fourteenth Day of February, 2012

David J. Kappos

David J. Kappos
*Director of the United States Patent and Trademark Office*